US006244992B1

(12) United States Patent
James

(10) Patent No.: US 6,244,992 B1
(45) Date of Patent: Jun. 12, 2001

(54) PORTABLE CALF STRETCHER

(75) Inventor: Allen G. James, Winnipeg (CA)

(73) Assignee: Donald Campbell, Winnipeg (CA); a part interest ( * ) Notice: Subject to any disclaimer, the term of this patent is extended or adjusted under 35 U.S.C. 154(b) by 0 days.

(21) Appl. No.: 09/461,225

(22) Filed: Dec. 16, 1999

Related U.S. Application Data

(60) Provisional application No. 60/112,768, filed on Dec. 17, 1998.

(51) Int. Cl.[7] ..... A63B 23/04

(52) U.S. Cl. ..... 482/79; 482/19

(58) Field of Search ..... 482/79–80, 148, 482/51, 19; 297/423.24, 423.32, 423.41, 423.46

(56) References Cited

U.S. PATENT DOCUMENTS

| | | | | |
|---|---|---|---|---|
| 2,144,962 | * | 1/1939 | Bresnahan | 482/19 |
| 3,401,931 | * | 9/1968 | Mccafferty et al. | 482/19 |
| 4,429,868 | | 2/1984 | LeBlanc et al. . | |
| 4,561,649 | | 12/1985 | Forsythe . | |
| 4,693,470 | | 9/1987 | Ogawa . | |
| 5,087,036 | | 2/1992 | Cooper . | |

* cited by examiner

*Primary Examiner*—Stephen R. Crow
(74) *Attorney, Agent, or Firm*—Adrian D. Battison

(57) ABSTRACT

A portable calf stretcher is provided having a base plate which is arranged to be supported on the ground. A foot plate and an adjustable support plate are pivotally mounted on opposing ends of the base plate. The adjustable support plate is arranged to support the foot plate above the base plate at any one of numerous fixed angles therebetween. A person positions one foot on the foot plate and leans forward for isolating and stretching the corresponding calf muscle. The foot plate is pivoted flat against the base plate in a storage position.

1 Claim, 2 Drawing Sheets

PORTABLE CALF STRETCHER

This application claims benefit of provisional application 60/112,768, filed Dec. 17, 1998.

FIELD OF THE INVENTION

This invention relates to a stretching device and more particularly to a portable calf stretcher for stretching calf muscles of a person.

BACKGROUND

When a person performs activities that require extensive use of their legs such as running, it is often desirable to stretch the leg muscles to avoid injury or to increase flexibility. The calf muscles in particular are difficult to isolate without the aid of a wall or similar structure to lean against. The use of various supports and devices are known for isolating the calf muscles, however these devices are generally awkward in shape and size such that they are not suitable to be carried while running.

U.S. Pat. No. 4,693,470 to Ogawa describes a device for use in stretching the Achilles' tendon and calf muscles of a person. A support base pivotally mounts a flat treading base thereon. An angle adjusting member supports the treading base on the support base at various angles therebetween. A person places their feet on the treading base and leans forward to perform stretching exercises of the lower leg. The device however is large and awkward in size such that it is not easily carried by an athlete while performing a running exercise. The angle adjusting member requires removal in order collapse the device for storage which further makes the device too awkward and bulky for an athlete to carry while running.

SUMMARY

According to one aspect of the present invention there is provided a portable stretching device for stretching calf muscles of a person, the device comprising:

a base member arranged to be supported on a supporting surface;

a foot plate suitably sized to support a single foot of the person thereon, the foot plate being pivotally mounted at a first end on the base member such that the foot plate is pivotal through a range of angles relative to the supporting surface; and an adjustable support pivotally mounted on the base member, the support being pivotal between a stretching position wherein the support engages the foot plate such that the foot plate is supported above the base member at a fixed angle therebetween within the range of angles and a storage position wherein the foot plate is oriented substantially flat adjacent the base member.

The portable calf stretcher is arranged to support a person's foot thereon at an upward incline such that the person's foot does not flex for isolating the person's calf muscles when the person leans forwards. The small size of the foot plate and pivotal coupling of the adjustable support allow the stretcher to be compactly stored for easily carrying the stretcher while running or exercising.

Preferably the first end of the foot plate is pivotally mounted on a corresponding first end of the base member, the foot plate and base member each comprising a substantially rectangular plate.

The adjustable support preferably comprises a rectangular plate member which is pivotally mounted on the base such that a free end of the plate member engages a bottom face of the foot plate at various locations, each corresponding to a fixed angle between the foot plate and the base member.

A plurality of stops may be mounted on the bottom face of the foot plate for engaging the free end of the adjustable support.

The adjustable support may be pivotally mounted on a second end of the base member opposite a first end mounting the foot plate thereon.

There may be provided a gripping member mounted on an upper face of the foot plate for gripping the foot of the person. Accordingly there may be provided a gripping member mounted on bottom face of the base member for engaging the supporting surface.

The adjustable support and the foot plate are preferably mounted on opposing ends of the base member wherein a combined length of the adjustable support and the base member is substantially equal to a length of the foot plate such that the adjustable support and the base member form a substantially flat and rectangular shape with the foot plate when collapsed in the storage position.

According to a further aspect of the present invention there is provided a portable stretching device for stretching calf muscles of a person, the device comprising:

a base member arranged to be supported on a supporting surface, the base member being substantially rectangular and having respective first and second ends;

a foot plate which substantially rectangular in shape and suitably sized to support a single foot of the person on an upper face of the plate, the foot plate being pivotally mounted at a coupled end on the first end of the base member such that the foot plate is pivotal through a range of angles relative to the base member;

and an adjustable support pivotally mounted at a coupled end on the second end of the base member, the support being pivotal between a stretching position wherein a free end of the support engages a bottom face of the foot plate such that the foot plate is supported above the base member at a fixed angle therebetween within the range of angles and a storage position wherein the foot plate and the adjustable support extending therefrom are oriented substantially flat adjacent the base member such that a combined length of the adjustable support and the base member is substantially equal to a length of the foot plate.

BRIEF DESCRIPTION OF THE DRAWINGS

In the accompanying drawings, which illustrate an exemplary embodiment of the present invention.

DETAILED DESCRIPTION

Figure 1:
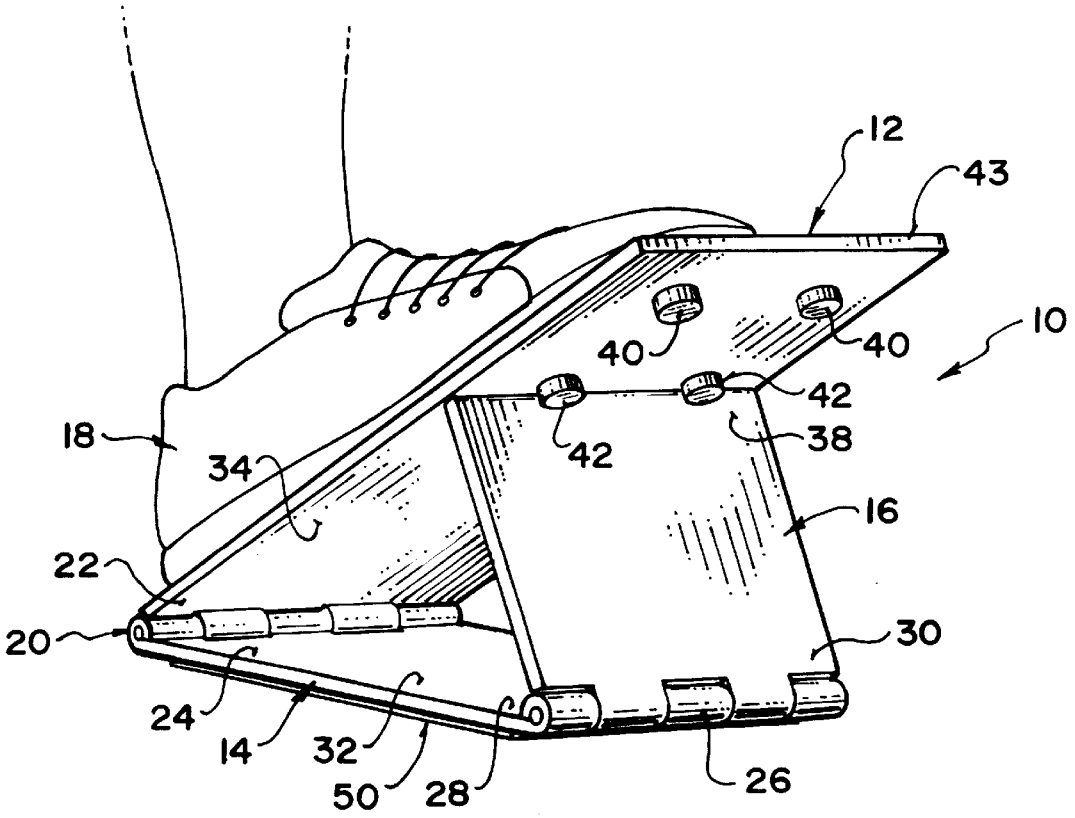
FIG. 1 is an isometric view of the portable calf stretcher showing a side and a rear of the device in a first stretching position.

Referring to the accompanying drawings, there is illustrated a calf stretcher generally indicated by the reference numeral 10. The calf stretcher 10 is a portable and collapsible device that can be carried by a person when jogging and easily assembled on any supporting surface for stretching the person's calf muscles.

The stretcher 10 includes a foot plate 12, a base plate 14 and an adjustable supporting plate 16. The foot plate 12 is a thin, flat plate appropriately sized to support a single foot 18 thereon being approximately twelve inches long and four inches wide such that an average size foot may be supported. A first hinge 20 is mounted along a heel end 22 of the foot plate 12.

The base plate 14 is equal in width to the foot plate and shorter in length. The base plate 14 is mounted on the first hinge 20 such that a first end 24 of the base plate is adjacent the heel end 22 of the foot plate. The base plate is pivotal in relation to the foot plate about the first hinge 20. The foot plate is thus pivotal through a range of angles relative to a supporting surface when the base plate is supported on the supporting surface. A second hinge 26 is mounted along a second end 28 of the base plate opposite the first end 24.

The supporting plate 16 is equal in width to and shorter in length than the base plate 14. The supporting plate 16 is mounted on the second hinge 26 such that a pivotal end 30 of the supporting plate is adjacent the second end 28 of the base plate. The supporting plate is pivotal in relation to the base plate about the second hinge 20.

Figure 2:
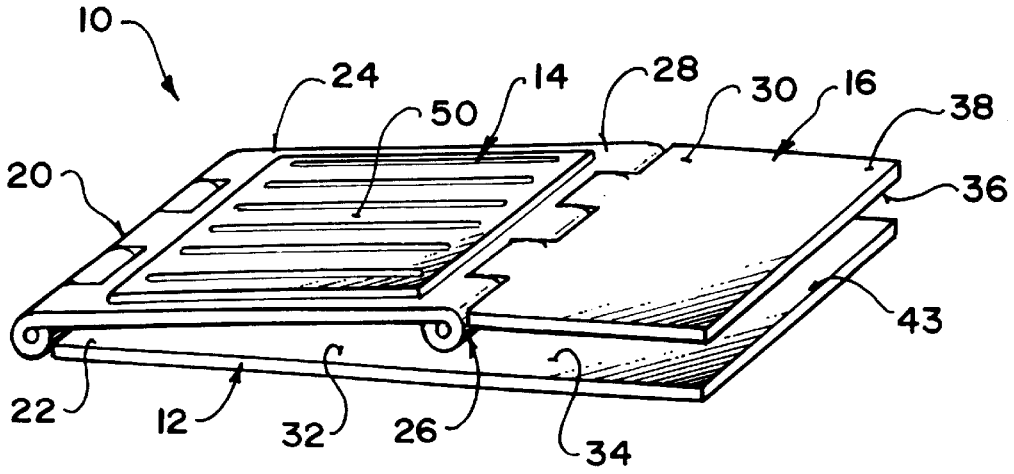
FIG. 2 is an isometric view of the portable calf stretcher showing a top and a side of the stretcher in a storage position.

The length of the supporting plate 16 and the base plate 14 combined is equal in length to the foot plate 12 such that the device may be folded into a portable position as shown in FIG. 2. The plates are all rectangular such that they form a substantially rectangular shape for storage in the portable position of FIG. 2. In the portable position an inner face 32 of the base plate lies adjacent to a bottom face 34 of the foot plate. The supporting plate extends from the base plate such that an inner face 36 of the supporting plate also lies adjacent to the bottom face 34 of the foot plate.

In use the free end 38 of the supporting plate 16 is arranged to engage the bottom face 34 of the foot plate 12 such that the foot plate 12, the base plate 14 and the supporting plate 16 form a triangular arrangement.

Figure 3:
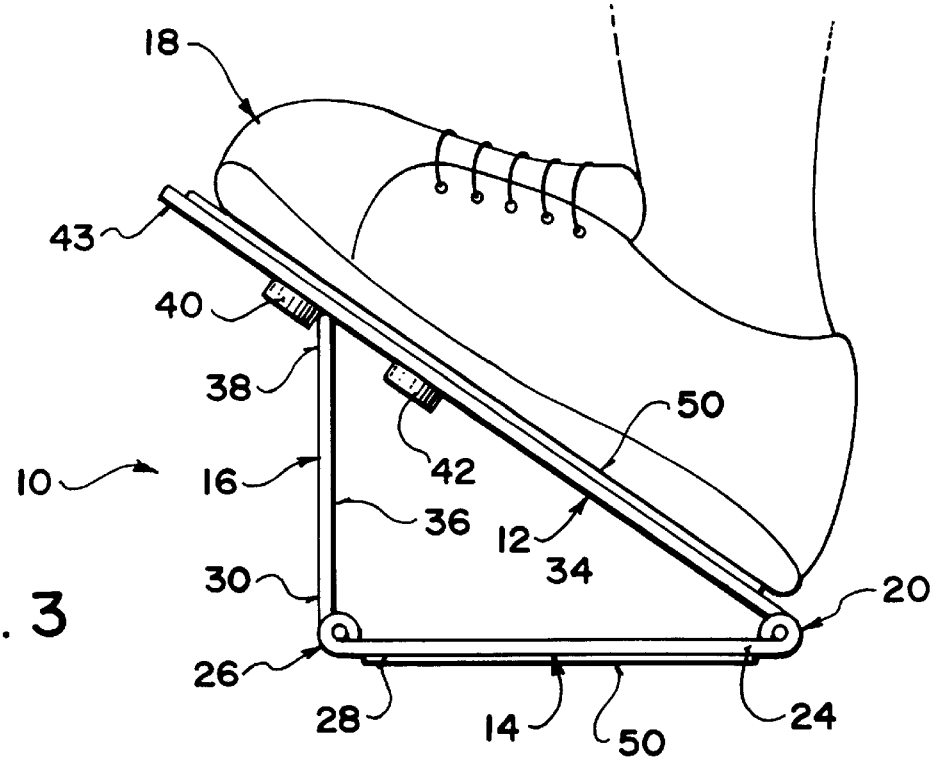
FIG. 3 is a side elevational view of the stretcher in the first stretching position.
Figure 4:
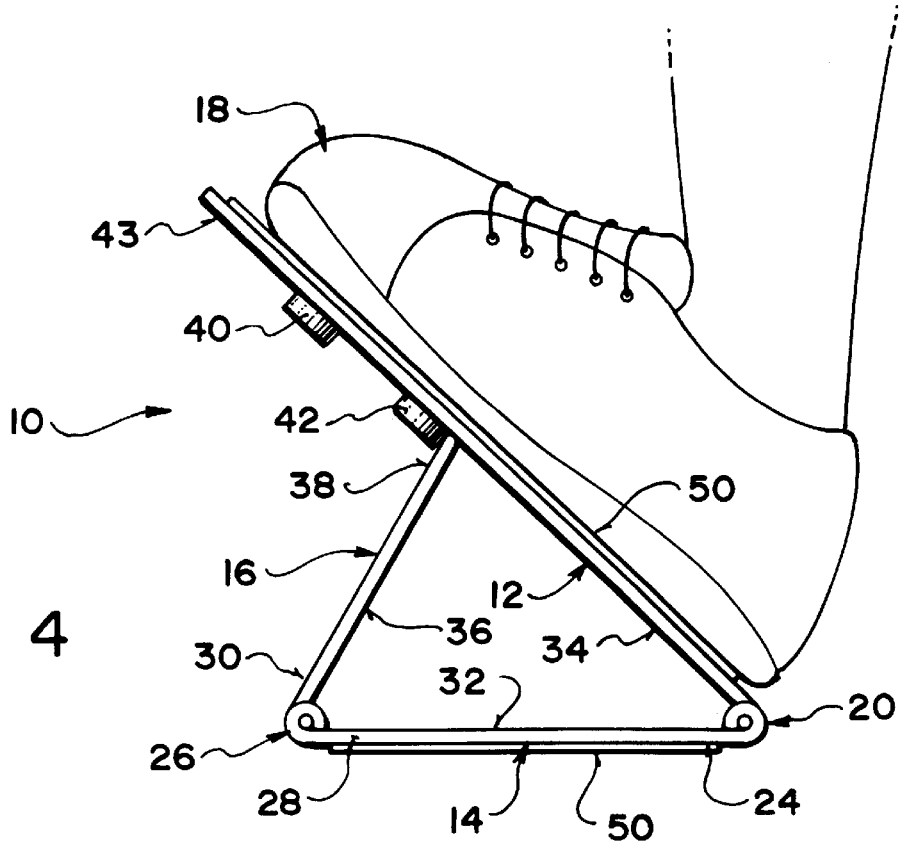
FIG. 4 is a side elevational view of the stretcher in a second stretching position.

The bottom face 34 of the foot plate 12 includes a pair of first lugs 40 and a pair of second lugs 42, each pair of lugs corresponding to a fixed angle between the foot plate and the base plate when the free end of the supporting plate is engaged thereon as shown in FIGS. 3 and 4 respectively. The pairs of lugs are spaced apart such that the first lugs 40 are positioned near a toe end 43 of the foot plate and the second lugs are spaced therefrom towards the heel end 22. The lugs 40 and 42 are fixed to the bottom face for engaging the free end of the supporting plate for positioning the foot plate as desired.

A first stretching position is shown in FIG. 3 wherein the free end 38 of the supporting plate engages the first lugs 40. With the base plate supported on a supporting surface, a person places their foot on the foot plate with their heel planted on the heel end and urges their leg upright and forwards such that their calf muscles are stretched. The foot plate remains flat such that the person's foot does not flex for isolating the calf muscles only.

A second stretching position is shown in FIG. 4 wherein the free end 38 of the supporting plate engages the second lugs 42. In the second stretching position, the base plate is supported on a supporting surface similarly to the first stretching position such that the foot plate extends upwards at a greater incline than the first stretching position. The second stretching position provides a more aggressive stretch for stretching once the person's muscles have already been warmed up and loosened.

The device is thus adjustable between the first and second stretching positions in use and collapsible into the portable position when not in use. In the portable position the device is small and lightweight such that it can be carried by a person while they are jogging or performing some similar exercise.

A rectangular sheet of gripping material 50 is mounted on the respective outer faces of both the base plate and the foot plate for gripping the supporting surface and the foot of the person respectively. The gripping material is a conventional rubber type sheet which is secured to respective plates by conventional means.

While one embodiment of the present invention has been described in the foregoing, it is to be understood that other embodiments are possible within the scope of the invention. The invention is to be considered limited solely by the scope of the appended claims.

What is claimed is:

1. A method of stretching calf muscles of a person, the method comprising:

providing a base plate having a lower gripping surface arranged to be supported on the ground and an upper mounting surface extending between respective first and second ends of the base plate;

providing a foot plate extending between respective first and second ends;

arranging the foot plate to be longer between the respective first and second ends thereof than the base plates;

providing on the foot plate an upper gripping surface suitably sized to support a single foot of the person thereon;

providing on the foot plate a plurality of stops mounted on a lower mounting surface of the foot plate at spaced positions between the respective first and second ends of the foot plate;

pivotally mounting the foot plate at the first end of the foot plate on the first end of the base plate such that the foot plate is pivotal through a range of angles relative to the base plate in which the foot plate extends upwardly over the base plate from the first end thereof mounted on the base plate to the second end thereof spaced above the second end of the base plate;

providing an adjustable support plate pivotally mounted on the second end of the base plate and extending outwardly therefrom to a free end of the adjustable support plate;

arranging the adjustable support plate to be pivotal between a stretching position in which the support plate extends upwardly from the base plate and the free end of the support plate engages a selected one of the stops on the lower mounting surface of the foot plate such that the foot plate is supported above the base plate at a fixed angle therebetween within the range of angles and a storage position in which the foot plate is oriented substantially flat adjacent the base plate with the lower mounting surface of the foot plate adjacent the upper mounting surface of the base plate;

gripping the lower gripping surface of the base plate on the ground;

adjusting a relative angle between the foot plate and the base plate within the range of angles corresponding to a desired degree of stretching;

pivoting the support member to extend upwardly from the second end of the base plate;

supporting one of the stops on the lower mounting surface of the foot plate on the free end of the support member corresponding to the desired degree of stretching;

placing substantially the entire foot of the person on the foot plate with a heel of the person adjacent the first end of the foot plate and corresponding toes of the person adjacent the second end of the foot plate; and urging a corresponding leg of the person forwardly towards the second end of the foot plate so as to position the leg to extend generally upright from the stretching device.

* * * * *